United States Patent [19]

Luke

[11] Patent Number: 4,527,572

[45] Date of Patent: Jul. 9, 1985

[54] TOBACCO SMOKE FILTERS

[75] Inventor: John A. Luke, Hampshire, England

[73] Assignee: Brown & Williamson Tobacco Corporation, Louisville, Ky.

[21] Appl. No.: 464,524

[22] Filed: Feb. 7, 1983

[51] Int. Cl.[3] ..... A24D 3/04

[52] U.S. Cl. ..... 131/336; 131/338; 131/339; 131/340

[58] Field of Search ..... 131/339, 340, 338, 336

[56] References Cited

U.S. PATENT DOCUMENTS 4,135,523 1/1979 Luke et al. ..... 131/209

4,273,141 6/1981 Tilburg ..... 131/340

*Primary Examiner*—V. Millin

*Attorney, Agent, or Firm*—Charles G. Lamb

[57] ABSTRACT

A filter for a smoking article such as a cigarette, comprising several grooves of varying depth between a shallow inlet end and a deep outlet end thereof, the outlet end face being air permeable to an extent greater than are the floor or the sides of each groove. A tipping enwrapping the filter plug has ventilation perforations in the region of the inlet end of each groove.

Alternatively, the grooves may have their median axes in a plane which is perpendicular to the axis of the filter plug, whereby the grooves extend circumferentially of the filter plug between the shallow inlet ends and the deep outlet ends.

11 Claims, 5 Drawing Figures

TOBACCO SMOKE FILTERS

DESCRIPTION

This invention relates to tobacco smoke filters for use with smoking articles, cigarettes for example.

It is well known to provide filter-tipped cigarettes with ventilation means which permit the ingress of ventilation air into the filter. A purpose of this is to effect a decrease in the mainstream delivery of smoke components. Another purpose of ventilating a filter is to cool the mainstream smoke. It has been observed that when ventilation air flows into a filter comprising a plug of fibrous filtration material, cellulose acetate for example, through a tipping ventilation zone extending around the filter, the tobacco smoke is constrained by the inflowing air to occupy a restricted axial zone of the filter plug. Thus a comparatively narrow stream of smoke passes from the mouth end of the plug into impingement with the taste preceptors in the mouth of the smoker. It is also the case that there is only a limited degree of mixing of the ventilation air with the tobacco smoke and therefore only a limited cooling of the smoke occurs.

It is an object of the invention to provide a tobacco smoke filter such that in use of that filter the smoker perceives an enhanced smoke character and the mainstream smoke is cooled to an improved degree.

The present invention provides a smoke filter including a rod-like plug of filtration material; wherein said plug has at least one airflow groove at its periphery, said groove increasing in depth from an inlet end to an outlet end of the groove; wherein the groove, when viewed as a development view of the plug, has a component of its length which is transverse to the axis of said plug; and wherein said groove has at its outlet end an outlet face which is pervious to airflow.

In order that the invention may be clearly understood and readily carried into effect, reference will now be made, by way of example, to the accompanying diagrammatic drawing, in which.

Figure 1:
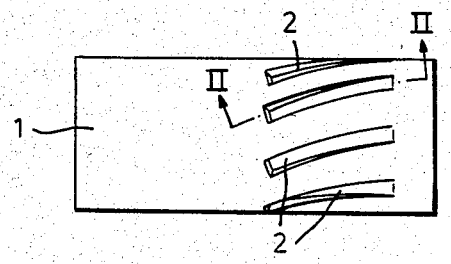
FIG. 1 shows a filter plug having helically extending peripheral airflow grooves.
Figure 2:
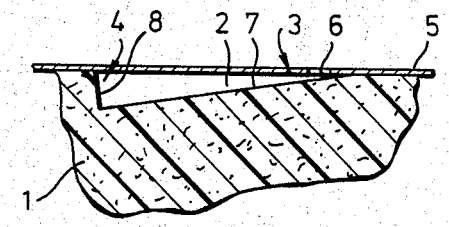
FIG. 2 shows part of the plug of FIG. 1 on the section line II—II and part of an overlying tipping wrapper.

The filter plug 1 of FIG. 1 is formed of fibrous cellulose acetate filtration material and is of self-sustaining construction. At the periphery of the plug 1 there extends a number of helical grooves 2. FIG. 2 shows one of the grooves 2 in section taken along the length of the groove. As may be seen from FIG. 2, the depth of the groove increases from an inlet end 3 to an outlet end 4 thereof. When assembled with a cigarette rod to provide a filter-tipped cigarette, the plug 1 is secured to the rod (not shown in FIG. 2) by a tipping 5, the cigarette rod being to the right of the plug 1 as viewed in FIG. 2. A row of perforations 6 in the tipping 5, one of which is depicted in FIG. 2, encircles the plug 1 at a location overlying an inlet end region of the grooves 2, the arrangement being such that at least a respective one of the perforations 6 is in communication with each of the grooves 2.

A convenient method of forming the grooves 2 is to subject the plug 1, or preferably a piece of filter rod material from which several of the plugs 1 are to be cut, to a hot-moulding process such as, for example, that disclosed in United Kingdom Patent Specification No. 1,507,765, using suitably shaped forming means. By a judicious selection of hot-moulding process conditions, the grooves 2 are so formed that the longitudinal surfaces 7 thereof are rendered substantially impervious to airflow therethrough, whereas the end face 8, the outlet face, of each groove 2 is pervious to airflow.

When a cigarette incorporating a filter as per FIGS. 1 and 2 is smoked, ambient air is drawn through the perforations 6 into the grooves 2. Since the grooves 2 follow helical paths and since the depth of each groove 2 increases in the direction of air flow, the ventilation air enters the body of the plug 1 with a helical and inwardly directed swirling motion. This has the effect of promoting an enhanced degree of mixing of the ventilation air with the tobacco smoke being drawn through the filter plug 1.

Figure 3:
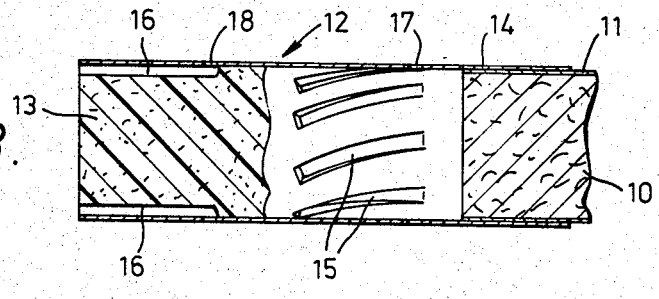
FIG. 3 shows part of a filter-tipped cigarette, the filter of which comprises a plug the form of which is a modification of the plug of FIG. 1.

The cigarette of FIG. 3 comprises a rod 10 of cut tobacco enwrapped in cigarette paper 11, and a filter 12 comprising a filter plug 13 which is secured to the rod 10 by a tipping 14. The filter plug 13 is similar to the plug 1 of FIG. 1 except that, in addition to being provided with helically extending grooves 15 at an upstream zone, the plug 13 is additionally provided with a number of parallel, longitudinally extending grooves 16 which open at the mouth end of the plug 13. As with the grooves 2 of FIGS. 1 and 2, the longitudinal surfaces of the grooves 15 may be substantially air-impervious as may also the surfaces of the longitudinal grooves 16. Two rows of perforations 17, 18 encircle the plug 13 at respective locations overlying the upstream ends of the helical and the longitudinal grooves 15 and 16 to provide means of ingress for ambient air into the grooves 15 and 16.

The plug 13 may, if desired, be replaced by two abutting sub-plugs of which one includes the grooves 15 and the other includes the airflow ducts 16.

When the cigarette of FIG. 3 is smoked, a first stream of ventilation air enters the body of the filter plug 13 from the peripheral grooves 15 and, by reason of the swirling motion imposed upon it, it mixes intimately with the tobacco smoke. A further stream of ventilation air enters the mouth of the smoker from the grooves 16 unmixed, or substantially unmixed, with the tobacco smoke.

Figure 4:
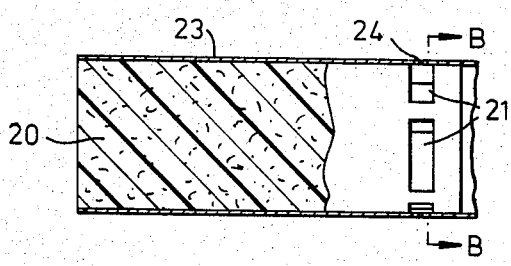
FIG. 4 shows a sectional view of a filter having a plug of a form different from that of the plug of FIG. 1.

The filter shown in FIG. 4 has its filter plug 20, which again is of self-sustaining construction, provided with peripheral grooves 21 disposed in an encircling row. Each of the grooves 21 has an inlet end and an outlet end between which the groove 21 extends in a direction substantially perpendicular to the axis of the filter plug 20. As may be seen from FIG. 5, each of the grooves 21 increases in depth towards its outlet end. An end face 22, defining the outlet face, of each groove 21 is pervious to airflow. The other surfaces of the grooves 21 are substantially impervious to airflow.

Overlying the filter plug 20 for the purpose of securing the plug 20 to a cigarette rod (not shown in FIG. 4) is a tipping 23, which tipping 23 is provided with a band 24 of micro-perforations encircling the plug 20 at a location overlying the grooves 21.

Figure 5:
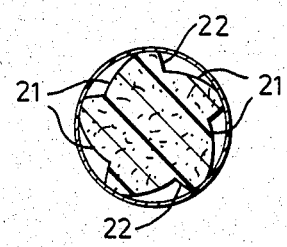
FIG. 5 shows a cross-sectional view taken at section line V—V of FIG. 4.

When a cigarette incorporating a filter as per FIGS. 4 and 5 is smoked, ambient air is drawn through the microperforated band 24 into the grooves 21. The air enters the body of the filter plug 20 through the outlet end faces 22 of the grooves 21 with a spiral motion which ensures intimate mixing of the air with the tobacco smoke.

In any of the embodiments described above the ventilation perforations may comprise microperforated regions of the tipping.

The tipping may, if desired, overlie a plug wrapper of air pervious nature in which case the tipping may form an outer impervious layer in which the perforations are formed. The tipping 5 would of course be longer than the plug wrapper.

It will be understood that the perforations 6, 17 and 18 shown in the drawings have been exaggerated in size so as to facilitate their illustration.

I claim:

1. In a smoke filter including:

(a) rod-like plug means of filtration material having a mouth end and an opposed smoke inlet end; and (b) airflow groove means at the periphery of said filter plug means, said airflow groove means having an air inlet end and an air outlet end;

the improvement wherein said airflow groove means has a depth increasing in a direction from said airflow groove inlet end and towards said airflow groove outlet end; said airflow groove means comprises means defining a plurality of airflow grooves arranged at equiangular spaced locations around said filter plug means; wherein the airflow groove means, when viewed as a development view of the filter plug means, has a component of its length which is transverse to the axis of said filter plug means; and wherein said airflow groove means includes, at its outlet end, means defining an outlet face which is pervious to airflow.

2. A filter according to claim 1, wherein said filter plug means has first and second axially consecutive regions with said airflow groove means formed in said first region and said second region contiguous to said mouth end, and further including ventilation airflow duct means extending along the filter plug means from the mouth end of the filter plug means along said second region and stopping short of said first region of said filter plug means.

3. A filter according to claim 2, wherein said filter plug means comprises first and second abutting filter sub-plugs, said first filter sub-plug including said airflow groove means and said second filter sub-plug including said ventilation airflow duct means.

4. In a smoke filter including:

(a) rod-like plug means of filtration material having a longitudinal axis, a mouth end, an opposed inlet end, and first and second axially consecutive regions with said second region near the mouth end, (b) airflow groove means at the periphery of said filter plug means, said airflow groove means having an air inlet end and an air outlet end; and (c) Wrapping means enwrapping said filter plug means;

the improvement wherein:

(d) said airflow groove means are disposed in said first region of the filter plug means;

(e) the airflow groove means has a depth increasing in a direction from said airflow groove inlet end towards said airflow groove outlet end thereof;

(f) the airflow groove means, when viewed as a development of the filter plug means, has a component of its length which is transverse to said longitudinal axis of said filter plug means;

(g) said airflow groove means includes, at its outlet end, means defining an outlet face which is pervious to airflow;

(h) airflow duct means defining ventilation airflow ducts extending along the filter plug means from the mouth end of the filter plug means along said second region and stopping short of said first region of said filter plug means; and (i) said wrapping means includes means defining first ventilation perforations surrounding said first region of the filter plug means for communicating with said inlet end of said airflow groove means and means defining second ventilation perforations around said second region of said filter plug means for communicating with said ventilation airflow duct means, said second ventilation perforation means being spaced from said mouth end of the filter plug means.

5. A filter according to claim 3, wherein said airflow groove means is of helical form.

6. A filter according to claim 3, wherein said inlet and outlet ends of said airflow groove means are equidistant from said mouth end of said filter plug means.

7. A filter according to claim 3, wherein said airflow groove means comprise means defining a plurality of airflow grooves arranged at equiangularly spaced locations around said filter plug means in said first region thereof.

8. A filter according to claim 3, wherein said airflow groove means includes means defining groove sides and means defining a groove floor which are less pervious to airflow than is said outlet face of the airflow groove means.

9. A filter according to claim 3, wherein said wrapping means has an inner air-pervious layer contiguous with said filter plug body and an outer layer in which said first and second ventilation perforation means are formed.

10. A smoke filter according to claim 3, wherein said first and second ventilation perforation means comprise first and second micro-perforated regions of the wrapping means.

11. A filter according to claim 3, wherein said filter plug means comprises first and second abutting filter sub-plugs, said first filter sub-plug including said airflow groove means and said second filter sub-plug including said ventilation airflow duct means.

* * * * *